US006724910B1

(12) United States Patent
Heed et al.

(10) Patent No.: US 6,724,910 B1
(45) Date of Patent: Apr. 20, 2004

(54) DIAPHRAGM STABLE THROUGH HYGROSCOPIC CYCLING

(75) Inventors: Thomas P. Heed, Greenwood, IN (US); Kirk R. Bristol, Ellettsville, IN (US); William J. Malinowski, Jr., Prairie Du Chien, WI (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 09/411,947

(22) Filed: Oct. 4, 1999

(51) Int. Cl.[7] ..... H04R 1/00; H04R 11/02; H04R 9/06

(52) U.S. Cl. ..... 381/423; 381/426

(58) Field of Search ..... 381/340, 396, 381/398, 403, 423, 424, 432, 426, 341, 343; 181/157, 164, 165, 171–173, 177, 186, 192, 195

(56) References Cited

U.S. PATENT DOCUMENTS

| | | | | |
|---|---|---|---|---|
| 3,221,834 A | * | 12/1965 | Noren et al. | 381/423 |
| 3,612,783 A | | 10/1971 | Schneider | |
| 3,780,232 A | | 12/1973 | Ward | |
| 3,834,486 A | | 9/1974 | Tsuge et al. | |
| 3,858,680 A | | 1/1975 | Tsuge et al. | |
| 3,946,832 A | | 3/1976 | Takano et al. | |
| 3,987,258 A | * | 10/1976 | Tsutsui | 181/149 |
| 3,997,023 A | * | 12/1976 | White | 181/171 |
| 4,071,111 A | | 1/1978 | Croup | |
| 4,140,203 A | | 2/1979 | Niguchi et al. | |
| 4,319,098 A | * | 3/1982 | Baitcher | 381/423 |
| 4,410,768 A | * | 10/1983 | Nakamura | 181/167 |
| 4,478,309 A | | 10/1984 | Kawamura et al. | |
| 4,552,243 A | * | 11/1985 | Melillo et al. | 181/169 |
| 4,554,414 A | * | 11/1985 | House | 381/423 |
| 5,008,945 A | | 4/1991 | Murayama et al. | |
| 5,319,718 A | | 6/1994 | Yocum | |
| 5,650,105 A | | 7/1997 | Yocum | |
| 5,734,734 A | | 3/1998 | Proni | |
| 6,026,929 A | * | 2/2000 | Faraone | 181/173 |
| 6,111,969 A | * | 8/2000 | Babb | 381/396 |

* cited by examiner

*Primary Examiner*—Curtis Kuntz
*Assistant Examiner*—P. Dabney
(74) *Attorney, Agent, or Firm*—Brinks Hofer Gilson & Lione

(57) ABSTRACT

A transducer has a body having an outer region which is generally straight tapered in cross section and an inner region which is generally an arc of a circle in cross section. The inner and outer regions meet along a closed plane tangent curve. The outer region includes a decoupling region which extends around the outer region along at least one closed plane curve.

26 Claims, 8 Drawing Sheets

DIAPHRAGM STABLE THROUGH HYGROSCOPIC CYCLING

FIELD OF THE INVENTION

This invention relates to transducers. It is disclosed in the context of an electrodynamic loudspeaker, but is believed to have utility in other applications as well.

BACKGROUND OF THE INVENTION

Most automotive original equipment loudspeakers have paper diaphragms. Automotive loudspeakers are almost inevitably exposed to extreme environmental conditions, such as, for example, exposure to water and to high humidity. Like most papers, the papers from which such loudspeaker diaphragms are constructed may warp when exposed to water and saturated or very humid air. Of course, warped diaphragms may perform poorly, for example, distorting the loudspeaker's sound or causing the loudspeaker's voice coil or voice coil former to rub against the frontplate of the loudspeaker's magnet assembly. Waterproof and water-resistant paper diaphragms are therefore highly desirable for automotive loudspeakers.

Various attempts have been made to reduce the sensitivity of loudspeaker diaphragms to atmospheric moisture. There are, for example, the loudspeakers described in U.S. Pat. Nos.: 3,612,783; 3,780,232; 3,834,486; 3,858,680; 3,946,832; 3,997,023; 4,071,111; 4,140,203; 4,478,309; 5,008,945; 5,319,718; 5,650,105; and, 5,734,734. This listing is not intended as a representation that a thorough search of the prior art has been conducted or that no more pertinent art than that listed above exists, and no such representation should be inferred.

DISCLOSURE OF THE INVENTION

According to the invention, a transducer has a body having an outer region which is generally straight tapered in cross section and an inner region which is generally an arc of a circle in cross section. The inner and outer regions meet along a closed plane tangent curve. The outer region includes a decoupling region which extends around the outer region along at least one closed plane curve.

Illustratively according to the invention, the closed plane tangent curve is substantially a circle.

Alternatively according to the invention, the closed plane tangent curve is substantially an ellipse.

Further illustratively, the at least one closed plane curve is substantially a circle.

Alternatively according to the invention, the at least one closed plane curve is substantially an ellipse.

Additionally illustratively according to the invention, the decoupling region includes at least one decoupling rib which forms a closed plane curve which extends around the body.

Illustratively according to this aspect of the invention, the decoupling region includes first and second, uniformly axially spaced decoupling ribs which form first and second closed plane curves, respectively, which extend around the body.

Illustratively according to this aspect of the invention, the decoupling region includes first and second, uniformly axially spaced decoupling ribs which form first and second closed plane curves, respectively, which extend around the body.

Illustratively according to the invention, the transducer body includes bleached and unbleached fibers treated with a silicone to render the body water resistant.

Further illustratively according to the invention, the outer region terminates at an outer perimeter. A surround couples the outer perimeter to the support. The surround includes a foam.

Illustratively according to this aspect of the invention, the foam includes a polyethylene terephthalate (PET) foam.

Additionally illustratively according to the invention, the surround includes a substantially parabolic cross section substantially perpendicular to the axis.

BRIEF DESCRIPTION OF THE DRAWINGS

The invention may best be understood by referring to the following detailed description and accompanying drawings which illustrate the invention. In the drawings.

DETAILED DESCRIPTION OF ILLUSTRATIVE EMBODIMENTS

Figure 1:
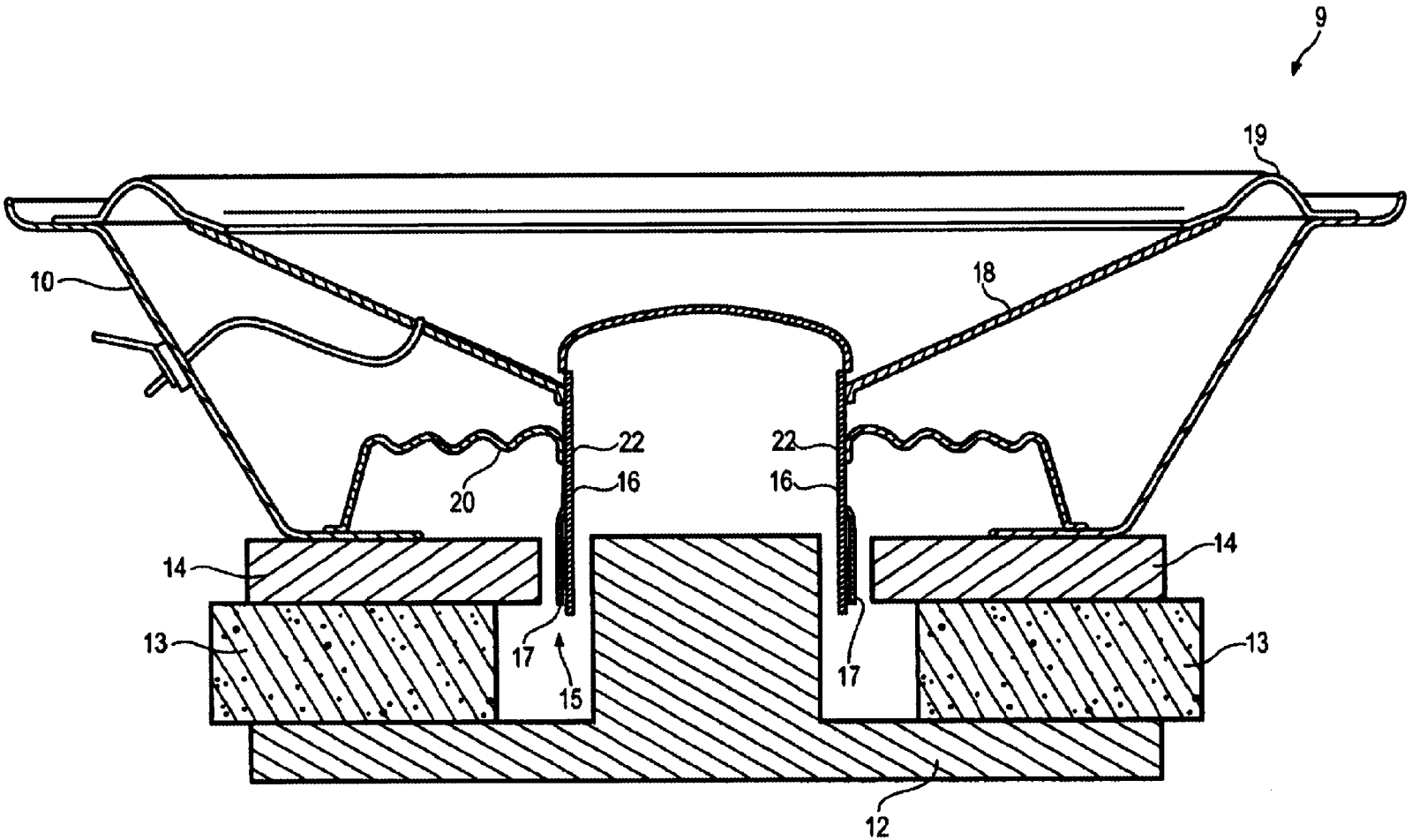
FIG. 1 illustrates a fragmentary cross-section through a loudspeaker constructed according to the invention.
Figure 2:
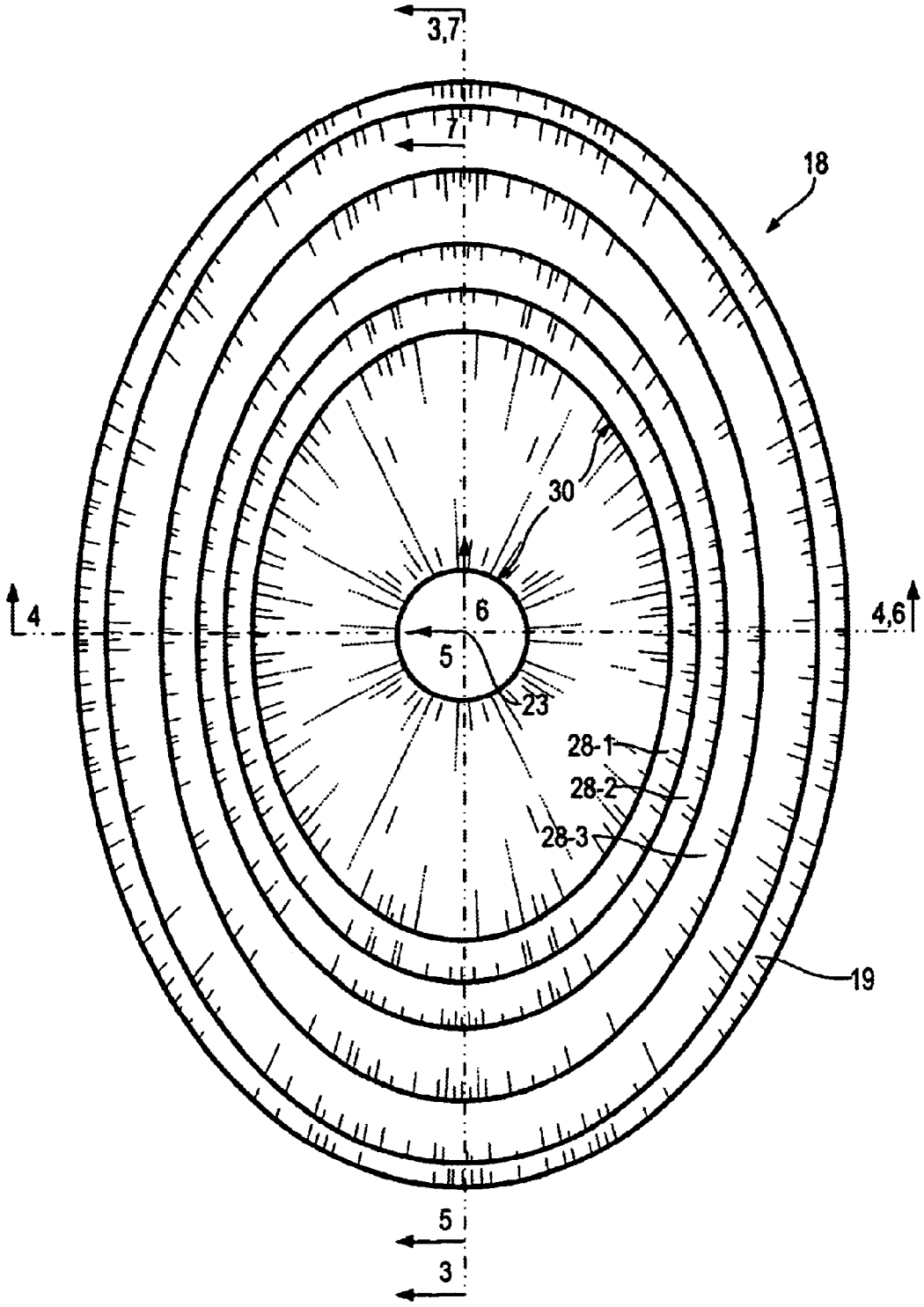
FIG. 2 illustrates a front elevational view of a detail of the loudspeaker illustrated in FIG. 1.
Figure 7:
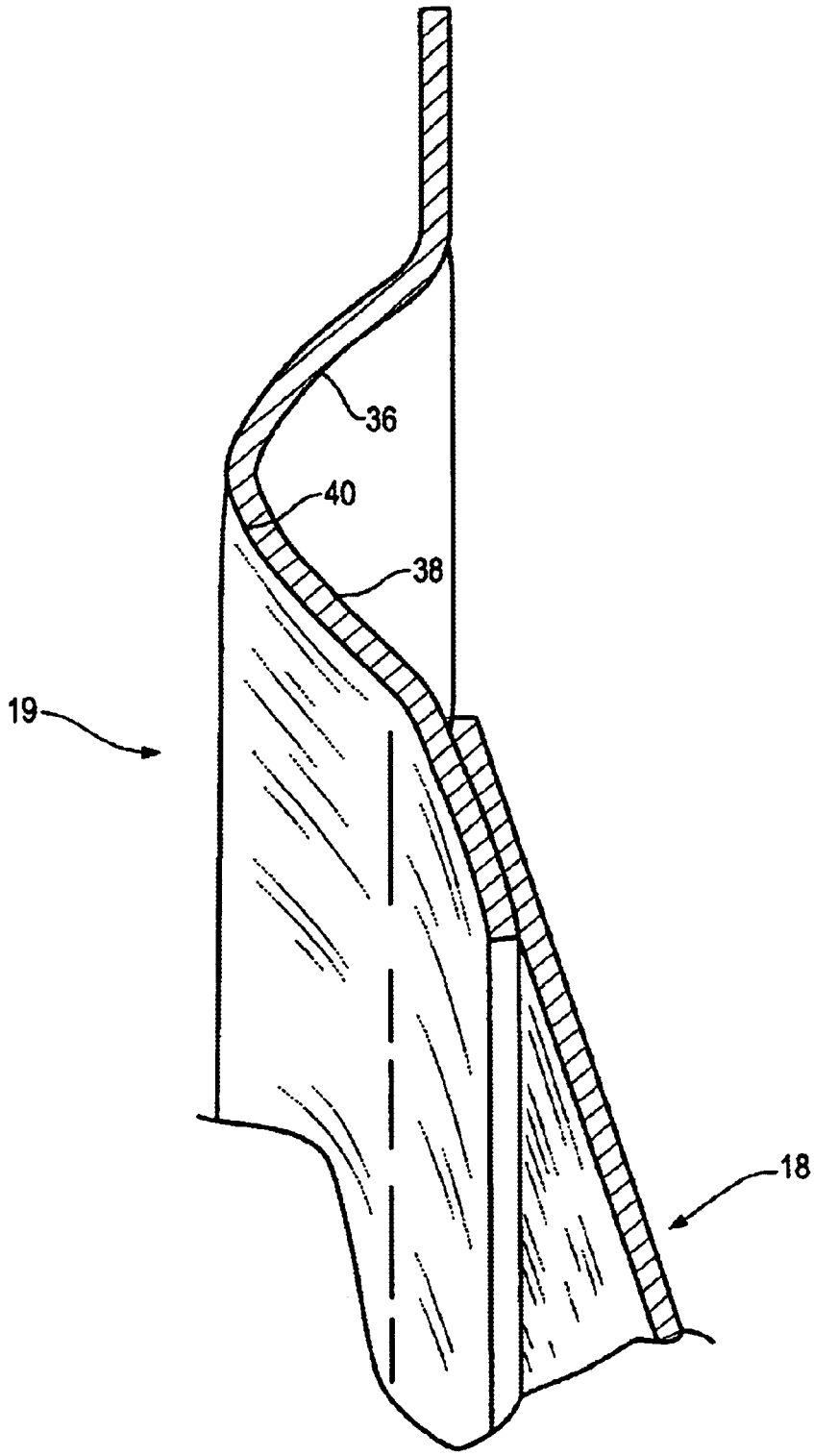
FIG. 7 illustrates an enlarged sectional view of the detail illustrated in FIG. 2, taken generally along section lines 7—7 thereof; and, FIG. 8 illustrates a front elevational view of an alternative detail to the detail illustrated in FIGS. 2–7.
Figure 8:
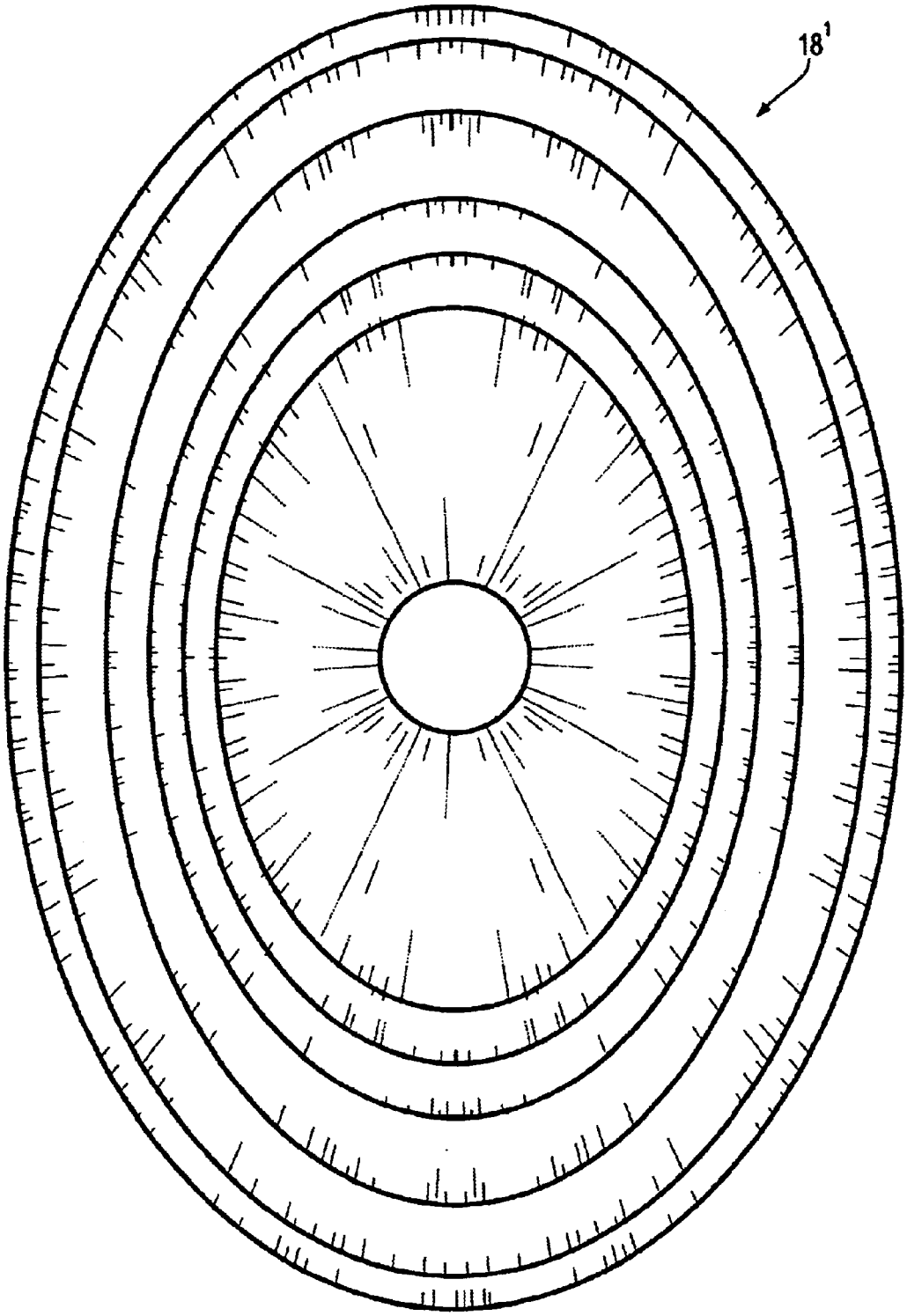

Referring now to FIG. 1, a loudspeaker 9 includes a supporting frame 10 and a motor assembly. The illustrated motor assembly includes a backplate/center pole 12, a permanent magnet 13, and a front plate 14 providing a substantially uniform magnetic field across an air gap 15. A voice coil former 16 supports a voice coil 17 in the magnetic field. Current related to the program material to be transduced by the loudspeaker 9 drives the voice coil 17, causing it to reciprocate axially in the air gap 15 in a known manner. A cone 18 attached at its apex to an end of the coil former 16 lying outside the motor assembly is coupled by a surround 19 at its outer perimeter to the frame 10. A spider 20 is coupled at its outer perimeter to the frame 10. The spider 20 includes a central opening 22 to which the voice coil former 16 is attached. The suspension including the surround 19 and spider 20 constrains the voice coil 17 to reciprocate axially in the air gap 15. Referring now to FIGS. 2–7, the illustrated cone 18 is an approximately six inch (about 15.2 cm) by approximately nine inch (about 22.9 cm) elliptical cone approximately one inch (about 2.5 cm) deep. Of course, it should be understood that the invention can be implemented equally successfully in cones having other, for example, circular, shapes perpendicular to their axes 23. FIG. 8 illustrates a front elevational view of such a cone 18'.

Cone 18 is constructed using, for example, a water-resistant or waterproof paper pulp, and a water-resistant or waterproof foam surround 19. The pulp from which cone 18 is formed is bleached and unbleached fibers with water-resistant silicone treatment. Paper is hygroscopic, so it expands as it takes up moisture and shrinks as it releases moisture. The silicone treatment reduces the hygroscopic nature of the paper so that it does not take up as much water from the atmosphere. Since it does not take up so much water, it of course does not release as much either. Cone 18 has cross sections that are circular arcs intersecting straight lines. Cone 18 also employs decoupling ribs 28 in its contour. This geometry is intended to distribute uniformly the stress of expansion and contraction due to swelling and shrinkage as water is taken up and released by the cone 18 material.

Figure 3:
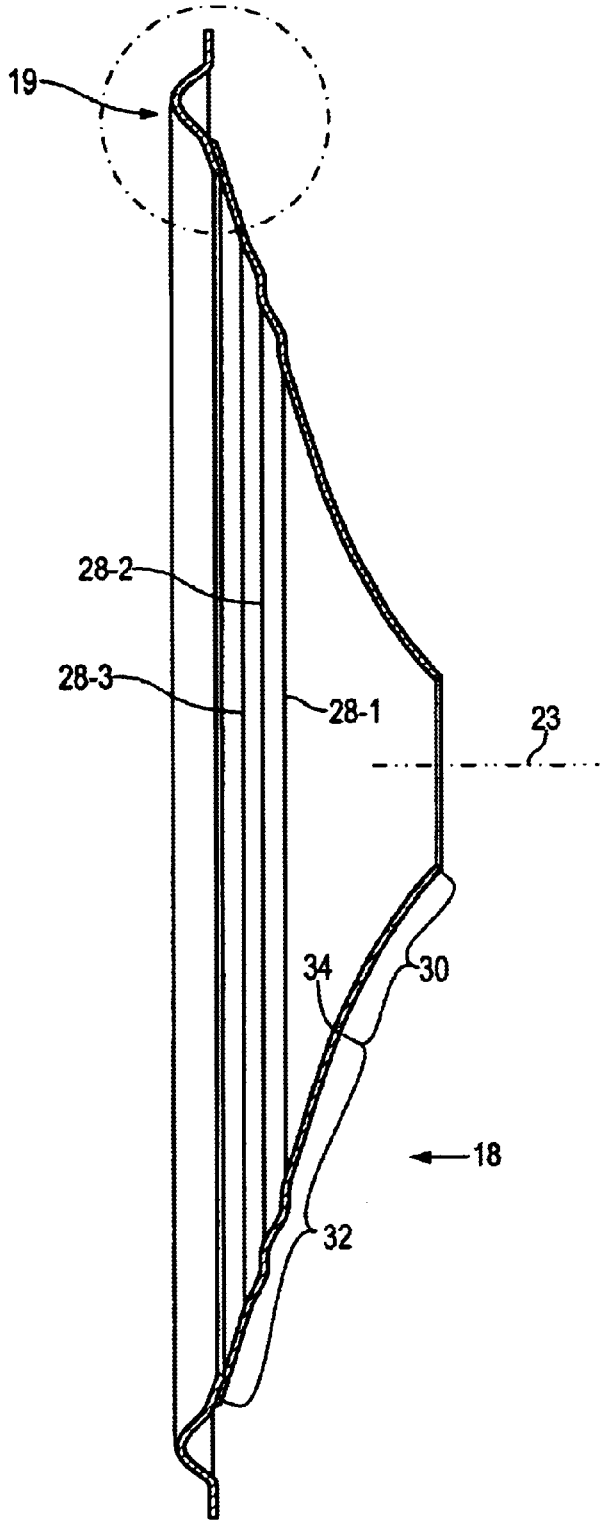
FIG. 3 illustrates a sectional view of the detail illustrated in FIG. 2, taken generally along section lines 3—3 thereof.
Figure 4:
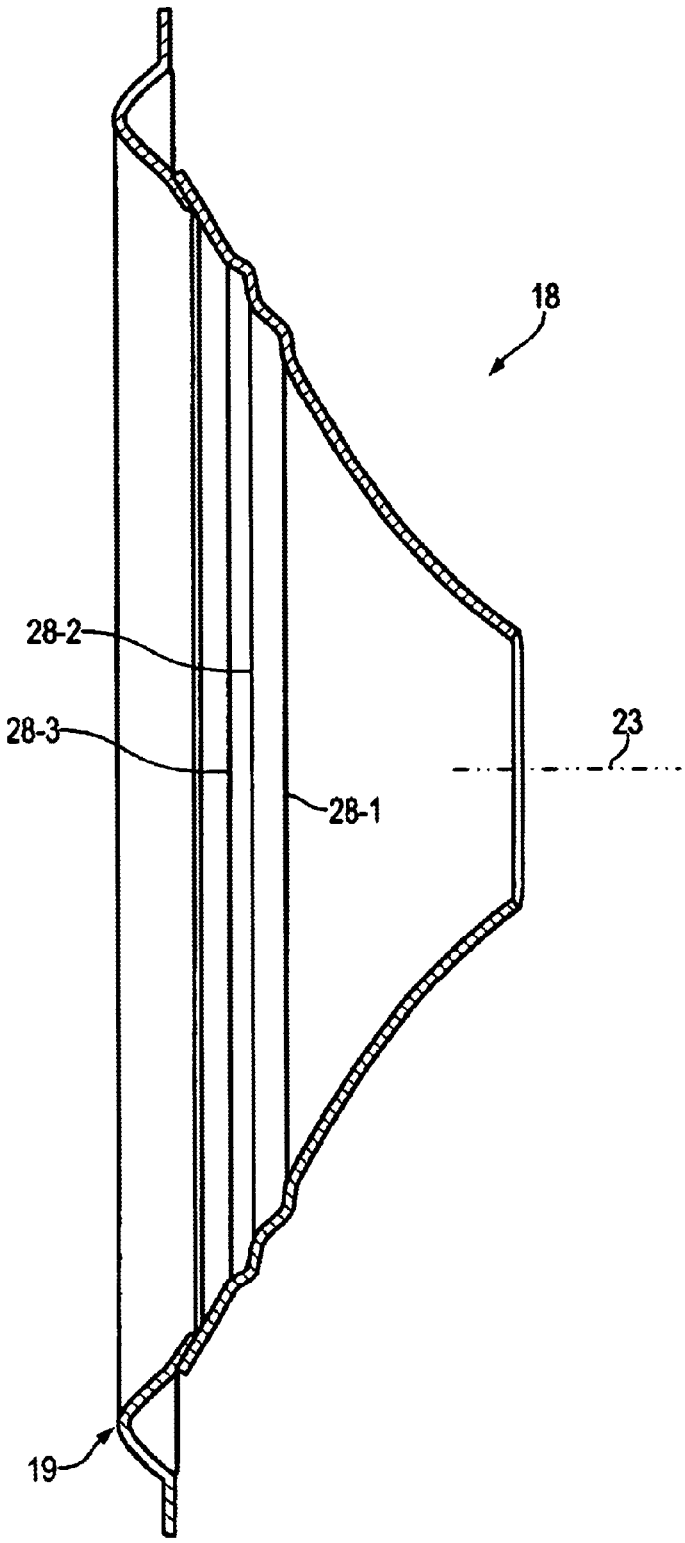
FIG. 4 illustrates sectional view of the detail illustrated in FIG. 2, taken generally along section lines 4—4 thereof.
Figure 5:
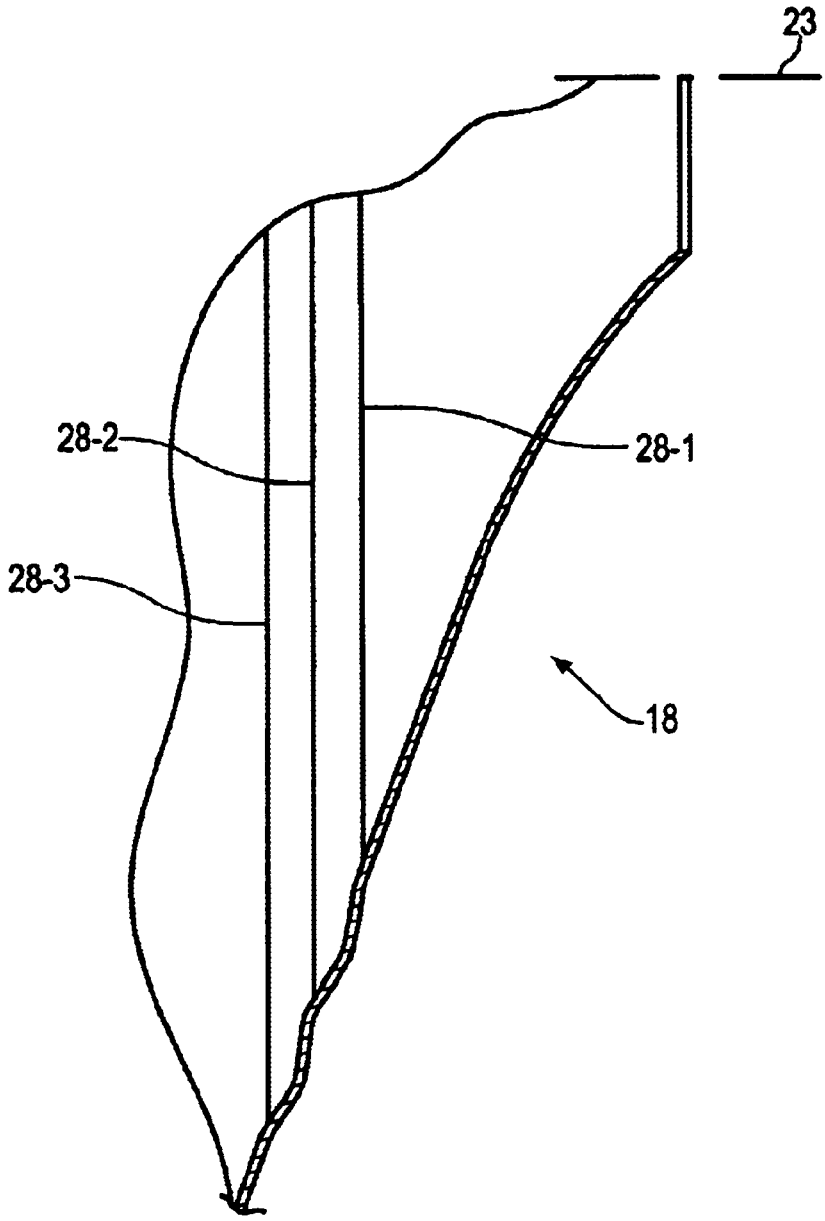
FIG. 5 illustrates a fragmentary sectional view of the detail illustrated in FIG. 2, taken generally along section lines 5—5 thereof.
Figure 6:
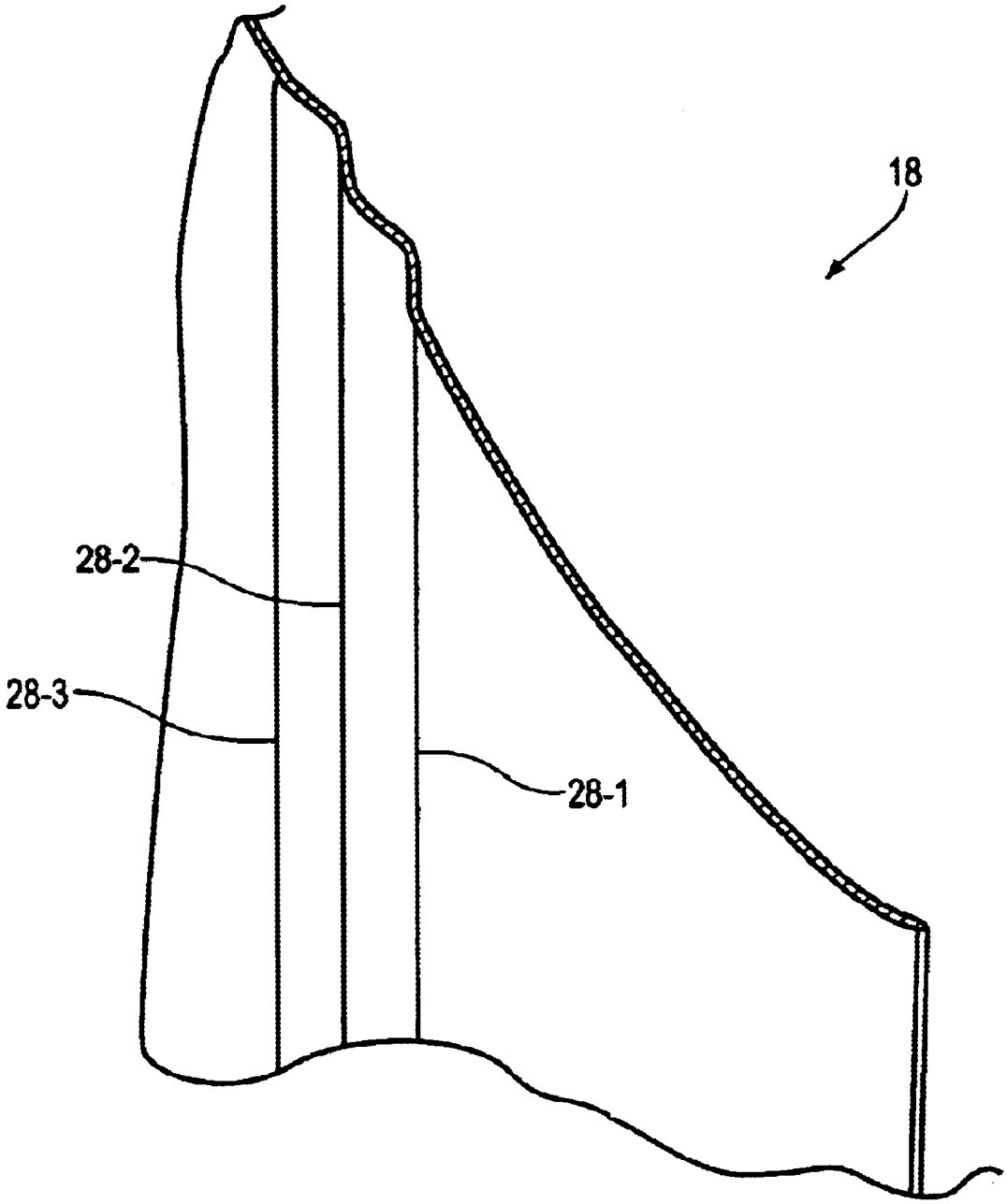
FIG. 6 illustrates an enlarged fragmentary sectional view of the detail illustrated in FIG. 2, taken generally along section lines 6—6 thereof.

Referring to FIGS. 3–4, the radially inner section 30 of cone 18 has a radius of curvature of, for example, 111.34 inches (about 282.8 cm). This section is tangent to the outer, generally straight line section 32 of cone 18 at points 34 at a radius of about 1.8 inches (about 4.578 cm) along the major axis of the ellipse from the axis 23 of the cone 18 and of the speaker 9. As best illustrated in FIGS. 4–5, the decoupling ribs 28 are positioned at radii of about 1.74 inches (about 4.43 cm) along the ellipse's minor axis from the axis 23 of the cone 18 (decoupling rib 28-1), about 1.93 inches (about 4.89 cm) along the ellipse's minor axis from the axis 23 of the cone 18 (decoupling rib 28-2), and about 2.11 inches (about 5.37 cm) along the ellipse's minor axis from the axis 23 of the cone 18 (decoupling rib 28-3).

The foam from which surround 19 is formed illustratively is polyethylene terephthalate (PET) foam. Referring particularly to FIG. 7, surround 19 has a generally parabolic cross section, as opposed to prior art semicircular cross sections. The radius of curvature 36 of the surround 19 adjacent frame 10 is about 0.06 inch (about 1.6 mm) on the side of surround 19 which is mounted to cone 18. The radius of curvature 38 of the surround 19 adjacent cone 18 is about 0.08 inch (about 2.14 mm) on the cone 18 side, and the radius of curvature 40 of the surround 19 on the side thereof which is not mounted to cone 18 is about 0.55 inch (about 13.97 mm). The height of the surround 19 is about 0.19 inch (about 4.81 mm). The material from which surround 19 is formed is not hygroscopic.

What is claimed is:

1. A transducer that is stable through hygroscopic cycling having a body that is water resistant, the body having an outer region which is generally straight tapered in cross section perpendicular to an axis of the transducer and an inner region which is an arc of a circle in cross section perpendicular to the axis, the inner region and outer region meeting along a closed plane tangent curve and uniformly distribute the stress of expansion and contraction due to hygroscopic cycling, the outer region including a decoupling region which extends around the outer region along at least one closed plane curve.

2. The apparatus of claim 1 wherein the at least one closed plane curve is substantially an ellipse.

3. The apparatus of claim 1 wherein the transducer body includes fibers treated with a silicone to render the body water resistant.

4. The apparatus of claim 1 including a transducer support, the outer region terminating at an outer perimeter, and a non-hygroscopic surround for coupling the outer perimeter to the support, the surround including a foam.

5. The apparatus of claim 1 wherein the closed plane tangent curve and the at least one closed plane curve are both substantially a circle.

6. The apparatus of claim 1 wherein the closed plane tangent curve and the at least one closed plane curve are both substantially an ellipse.

7. The apparatus of claim 4 wherein the foam includes a polyethylene terephthalate (PET) foam.

8. The apparatus of claim 4 or 7 wherein the non-hygroscopic surround includes a substantially parabolic cross section substantially perpendicular to the axis.

9. The apparatus of claim 1, 2, 3, 4 or 7 wherein the outer region terminates at an outer perimeter which is non-circular.

10. The apparatus of claim 8 wherein the outer region terminates at an outer perimeter which is non-circular.

11. A transducer that is stable through hygroscopic cycling having a body that is water resistant, the body having an outer region which is generally straight tapered in cross section perpendicular to an axis of the transducer and an inner region which is an arc of a circle in cross section perpendicular to the axis, the inner region and outer region meeting along a closed plane tangent curve, the outer region having a decoupling region that includes at least one decoupling rib which forms a closed plane curve which extends around the body, the transducer also including a transducer support, the outer region terminating at an outer perimeter, and a non-hygroscopic surround for coupling the outer perimeter to the support, the non-hygroscopic surround including a foam, wherein the non-hygroscopic surround includes a substantially parabolic cross section substantially perpendicular to the axis.

12. The apparatus of claim 11 wherein the decoupling region includes first and second, uniformly axially spaced decoupling ribs which form first and second closed plane curves, respectively, which extend around the body.

13. The apparatus of claim 11 wherein the decoupling region includes first, second and third, uniformly axially spaced decoupling ribs which form first, second and third closed plane curves, respectively, which extend around the body.

14. The apparatus of claim 11 wherein the transducer body includes fibers treated with a silicone to render the body water resistant.

15. The apparatus of claim 11 wherein the non-hygroscopic foam includes a polyethylene terephthalate (PET) foam.

16. The apparatus of claim 11 wherein the outer region terminates at an outer perimeter which is non-circular.

17. A transducer that is stable through hygroscopic cycling, the transducer comprising: a body that includes fibers treated with a silicone to render the body water resistant, the body having an outer region which is generally straight tapered in cross section perpendicular to an axis of the transducer and an inner region which is an arc of a circle in cross section perpendicular to the axis, the inner region and outer region configured to meet along a closed plane tangent curve and uniformly distribute the stress of expansion and contraction due to hygroscopic cycling.

18. The transducer of claim 17 wherein the outer region includes a decoupling region extending around the outer region along at least one closed plane curve.

19. The transducer of claim 18 wherein the at least one closed plane curve is substantially an ellipse.

20. The transducer of claim 18 wherein the decoupling region includes at least one decoupling rib forming a closed plane curve which extends around the body.

21. The transducer of claim 18 wherein the decoupling region includes first and second, uniformly axially spaced decoupling ribs which form first and second closed plane curves, respectively, extending around the body.

22. The transducer of claim 18 wherein the decoupling region includes first, second and third, uniformly axially spaced decoupling ribs which form first, second and third closed plane curves, respectively, extending around the body.

23. The transducer of claim 17 including a transducer support, the outer region terminating at an outer perimeter, and a surround for coupling the outer perimeter to the support, the surround including a foam.

24. The transducer of claim 23 wherein the foam includes a polyethylene terephthalate (PET) foam.

25. The transducer of claim 23 wherein the surround includes a substantially parabolic cross section substantially perpendicular to the axis.

26. The apparatus of claim 23 wherein the outer region terminates at an outer perimeter which is non-circular.

* * * * *